United States Patent [19]

Goellner

[11] Patent Number: 4,588,324

[45] Date of Patent: May 13, 1986

[54] SLALOM POLE

[76] Inventor: Hermann Goellner, Stratton Mountain School, Stratton, Vt. 05155

[21] Appl. No.: 569,458

[22] Filed: Jan. 9, 1984

[51] Int. Cl.[4] ..... E01F 9/01

[52] U.S. Cl. ..... 404/10; 404/9

[58] Field of Search ..... 404/10, 9; 40/608, 612; 52/113; 248/160, 599, 600, 622, 623

[56] References Cited

U.S. PATENT DOCUMENTS

| | | | |
|---|---|---|---|
| 1,250,064 | 12/1917 | Whims | 40/608 |
| 1,726,817 | 9/1929 | Franklin | 404/10 X |
| 2,050,579 | 8/1936 | Murray | 40/612 |
| 2,286,959 | 6/1942 | Haines | 40/612 X |
| 2,949,324 | 8/1960 | Birge et al. | 404/10 X |
| 3,279,133 | 10/1966 | De Korte | 404/10 X |
| 3,478,715 | 11/1969 | Asbury | 404/10 X |
| 3,698,144 | 10/1972 | Stratton | 52/99 |
| 4,073,254 | 2/1978 | Marker | 114/90 |
| 4,270,873 | 6/1981 | Laehy et al. | 404/10 |
| 4,491,438 | 1/1985 | Berutti | 404/10 |

FOREIGN PATENT DOCUMENTS

| | | | |
|---|---|---|---|
| 42810 | 12/1981 | European Pat. Off. | 404/10 |
| 1967075 | 3/1977 | Fed. Rep. of Germany | 404/10 |

*Primary Examiner*—Stephen J. Novosad
*Assistant Examiner*—Matthew Smith
*Attorney, Agent, or Firm*—Marmorek, Guttman & Rubenstein

[57] ABSTRACT

A pole which is adapted to be supported in the ground, includes a lower part to be placed in the ground and an upper part extending upwardly above the ground. The upper part is adapted to pivot against the lower part when subjected to an impact force from any direction. The pole includes restoring means for returning the upper portion of the pole to its normally aligned upward position following cessation of the force.

7 Claims, 3 Drawing Figures

SLALOM POLE

BACKGROUND OF THE INVENTION

1. Field of the Invention

This invention relates to a pole for use in delineating boundaries, such as a slalom pole marking boundaries along a ski slope and, in particular, to a pole constructed to facilitate a bending of its upper portion upon impact due to a moving object, for example, striking of the pole by a down-hill skier. The instant pole is so constructed as to minimize any injuries to the skier or damages to the pole.

2. Description of the Prior Art

Generally, slalom poles are known in the prior art.

One such structure is shown in U.S. Pat. No. 3,279,133 to De Korte. De Korte discloses a boundary marker; the upper part of it is adapted to return to the vertical position after being struck by a moving object. This device comprises hollow upper and lower pole sections which are joined by means of an external spring threaded onto both the upper and lower sections. When the pole is struck, the spring is flexed, allowing the upper pole to pivot at ground level and return to the vertical. A drawback of this device is that the spring itself bends and thus is liable to become distorted upon continued use. Furthermore, at ground level the spring is external to the device and susceptible to corrosion and impairment to function due to clogging from such substances as dirt and ice.

The device disclosed in U.S. Pat. No. 4,270,873 to Laehy et al. overcomes many of the disadvantages of the patent to De Korte by housing the spring within the pole. This eliminates the exposure of the spring to damaging elements. The patent to Laehy, however, suffers from the drawback that if the pole is bent more than 90° there are no means for ensuring that the spring coils are urged together so as to resurrect the pole to a vertical position. This would therefore require to adjust the pole manually after each collision with attendant delays and therefore make it impractical for use in such events as slalom races. Furthermore, as snow can accumulate in the lower tubes of the pole, this may cause icing up and breaking of the spring. Another disadvantage of the patent to Laehy is that no anchoring means is provided at the bottom end of the pole to ensure that the pole be firmly secured in either ice or in deep light snow, which are typical environments in slalom races.

Reference is also made to the U.S. Pat. No. 1,726,817 to Franklin and the U.S. Pat. No. 2,050,579 to Murray. Both relate to traffic signals. Both of these patents have a solid pole, the bottom portion of which is inserted in a resilient tube. The major drawback of this type of structure is that the upper portions of the pole can be broken off upon impact.

U.S. Pat. No. 3,698,144 to Stratton relates to a detachable post anchor for use with highway marker posts. This construction has no resilient means for returning the pole to the original position upon impact, and the anchor includes a spike which is to be driven into the ground and therefore requires a great deal of effort in securing it onto an icy surface.

Reference is made to U.S. Pat. No. 2,286,959 to Haines which relates to a Highway Traffic Post.

Reference is lastly made to U.S. Pat. No. 4,073,254 to Marker which relates to a sailing mast for sailing boards having a flexible portion at the bottom of the mast for bending. A major drawback of this structure is that it uses a sprung rope to resist the bending of the mast, and is, of course, bare of any anchoring in snow or ice.

SUMMARY OF THE INVENTION

It is therefore one of the principal objects of the invention to provide a delineating pole, a visible part of which is pivotable upon impact by force, and which returns to its normally aligned upward position following cessation of such a force.

It is another object to avoid the aforementioned drawbacks of the prior art proposals.

It is a further object of the invention to provide a delineator pole which is pivotable upon impact, and which can be secured firmly into any type of ground including one covered by either ice or by deep light snow.

Further objects and advantages of the invention will be set forth in part in the following specification and in part will be obvious therefrom without being specifically referred to, the same being realized and obtained as pointed out in the claims hereof.

BRIEF DESCRIPTION OF THE DRAWINGS

For a fuller understanding of the nature and objects of the invention, reference should be had to the following detailed description, taken in connection with the accompanying drawings, in which.

DESCRIPTION OF THE PREFERRED EMBODIMENTS

Figure 1:
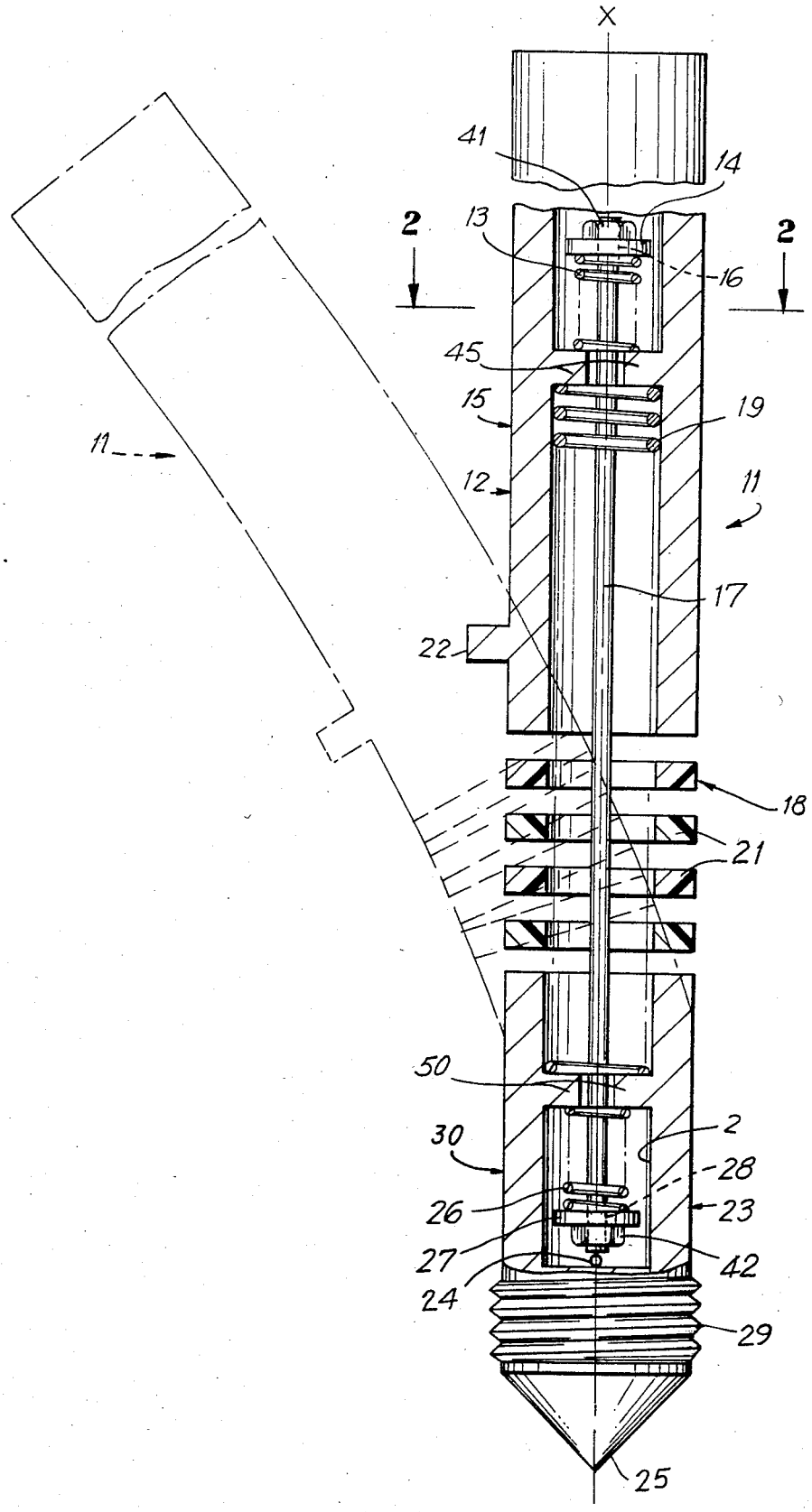
FIG. 1 is a fragmentary longitudinal sectional view taken on line 1—1 of FIG. 2, showing a preferred embodiment of the present invention.
Figure 2:
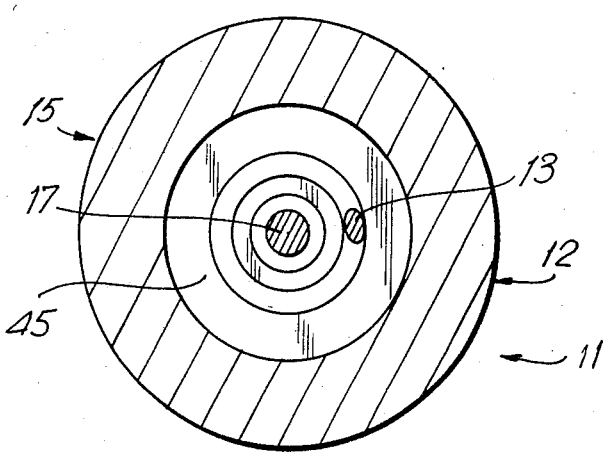
FIG. 2 is a cross-sectional view taken along line 2—2 of FIG. 1.

Referring now to the drawings, in particular FIG. 1, a pole 11 is shown which includes a lower part 30 adapted to be placed in the ground and an upper part 15 extending upwardly above the ground and which is adapted to pivot against the lower part 30 when subjected to an impact force.

The upper part 15 includes an upper portion 12. The lower part 30 includes a lower portion 23. A middle portion 18 is disposed between the upper 12 and the lower 23 portions, all three portions together forming a substantially continuous external surface which is coaxially aligned so that the center of the pole 11 is aligned along the vertical axis X.

The invention is not restricted to implementation in an upright position. Therefore, the terms upper part, upper portion, lower part, lower portion, middle portion, upright and vertical axis X are not intended to be understood in any limiting sense, but are used only for the purpose of clarity in describing the instant invention in connection with the specific embodiments shown in the drawings hereof.

The upper 12, middle 18, and lower 23 portions are held together in tension by a sprung axial cable 17.

The upper portion 12 and the lower portion 23 each include a respective spring 13, 26 which is coaxially disposed therein. The upper portion 12 and the lower portion 23 each includes circular projectiles 45, 50. One end of each of the springs 13, 26 abut the respective circular projectiles 45, 50. Passages are defined between the circular projectiles 45, 50 which are sufficiently narrow so that the circular projectiles 45, 50 contain the springs 13, 26 in the respective portions 12, 23 of the pole 11.

The sprung cable 17 extends through the upper portion 12, the middle portion 18 and the lower portion 23 of the pole 11. The cable 17 protrudes through the passageways defined by the circular projectiles 45, 50. Platform plates 14, 27 are located in the upper portion 12 and in the lower portion 23 respectively. The platform plates 14, 27 each have a respective aperture 16, 28 through which the ends of the cable 17 protrude. Nuts 41, 42 are provided for the upper platform plate 14 and the lower platform plate 27 and tightly secure the protruding ends of the cable 17 so as to remove slack and to pretension the cable 17.

The springs 13, 26 acting in conjunction with platform plates 14, 27, nuts 41, 42 and the sprung cable 17 provide restoring means for urging the upper portion 12 to return to its normal position in alignment with the lower portion 23 of the pole 11 when the upper portion 12 has been pivotted from its normal position.

When the pole 11 is subjected to an impact force, the upper part 15 pivots against the lower part 30 causing the pole 11 to bend. Due to the bending, the springs 13, 26 will become loaded, thereby storing energy for the subsequent retrieval of the bent upper portion 12 of the pole 11 into its original upright position.

The middle portion 18 of the pole 11 includes flexible reinforcing means such as a tension spring 19 which extends throughout the inside of the middle portion 18 and into the upper 12 and lower 23 portions of the pole 11. The middle portion 18 further includes a series of superposed annular members such as external collars 21. It is preferable if the collars 21 are nylon collars. The tension spring 19 cooperates with the collars 21 to promote the flexible bending of the upper portion 12 relative to the lower part 30 of the pole 11.

FIG. 1 shows the pole in solid lines in an upright position, and in broken lines in a bent position after sustaining an impact from the colliding object. As can be seen from FIG. 1, the collars 21 promote a flexible bending of the upper portion 12 of the pole 11. The collars 21 assume angular positions along the curvature of the bent surface of the pole 11. The collars 21 provide for a flexible bending radius of flexure of the pole 11, thereby minimizing the danger of breakage of the pole 11 due to bending. The collars 21 also serve to keep out dirt and snow from normally entering into the pole 11. The middle portion 18 further includes external wrench engaging means 22 for securing the pole 11 into the ground, as discussed below in detail.

The lower portion 23 of the pole 11 includes ground engagement means such as an external thread 29 that is formed on a nose piece 25 as shown in FIG. 1. The nose piece 25 is made of aluminum, and the nose piece 25 is detachably connected to the pole 11 and is utilized for securing the pole 11 into an icy surface.

The wrench engaging means 22 is adapted to be engaged by a wrench (not shown) in order to rotate the pole 11 about its longitudinal axis X in one direction. This rotation permits the external thread 29 to thread the lower portion 23 of the pole 11 into the ground. The pole 11 may be removed in a similar manner by engaging the wrench engaging means 22 so as to rotate the pole about its longitudinal axis in an opposite direction.

The lower portion 23 of the pole 11 has an aperture 24. The aperture 24 provides for drainage of any snow which may become packed into the hollow 2 of the pole 11 while it is threaded into the ground. This prevents the icing up and breaking of the spring 26.

Figure 3:
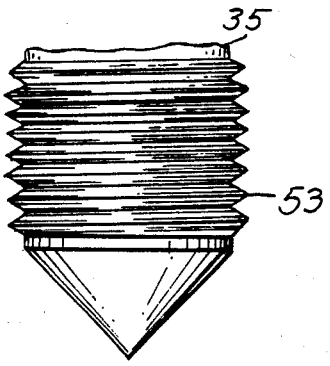
FIG. 3 is a fragmentary sectional view similar to a portion of FIG. 1 but showing a modification.

As previously mentioned, FIG. 1 shows the lower portion 23 with ground engaging means including a short piece with the external thread 29, which is suitable for threading the pole into an icy surface. FIG. 3 shows another embodiment of the invention wherein long ground engagement means such as a long bottom piece 35 with an external thread 53 is utilized for threading the pole 11 in surfaces of deep light snow. This long bottom piece 35 with external thread 53 is detachably connected to the pole 11.

The upper portion 12 of the pole 11 may include an opening for receiving a rod which illustratively has a flag mounted thereon.

OPERATION

The invention operates as follows: Upon collision with an object or person, the pole 11 will bend in a similar manner to that shown in FIG. 1 in broken lines. The tension spring 19 will cooperate with the collar 21 to promote the flexible bending of the upper portion 12 relative to the lower part 29. Upon cessation of the impact force, the upper and lower springs 13, 26 acting in conjunction with the cable 17 and the platform 14, 27 and the respective nuts 41, 42 and the circular projectiles 45, 50 will urge the upper portion 12 to return to its normally aligned position.

The collars 21 will serve to promote the flexible bending of the pole 11 and reduce the possibility of brakage of the pole 11 during its bending.

ADVANTAGES

Certain advantages of the invention have already been referred to herein. It may be useful, however, to allude to one major advantage, namely, the tensioning of the sprung cable 17 will result in a realignment of the upper part 12 of the pole 11 into its normal upright position.

A further advantage is that use of compression springs for upper spring 13 and lower spring 26 will help facilitate the realignment of the upper part 12 of the pole 11 should it be bent out of its normal alignment by more than 90°.

I do not limit myself to any particular details of construction set forth in the specification and illustrated in the accompanying drawings, as the same refer to and ser forth only one embodiment of the invention and it is observed that the same may be modified within the scope of the appended claims, without departing from the spirit and scope of the invention.

Having thus described the invention, what I claim as new and desire to be secured by Letters Patent is as follows:

1. A slalom pole adapted to be supported in snow, ice and/or the ground, including a lower part adapted to be placed in the ground and an upper part extending upwardly above the ground and being adapted to pivot against the lower part when subjected to an impact force from a skier in any direction, comprising, in combination, said lower part including a lower portion comprising threading means for anchoring it in an upward position in the snow, ice, and/or ground, said upper part including an upper portion surmounting the lower portion and normally being aligned therewith and being pivotally movable relative to the lower part over a radius of flexure, a middle portion disposed between said upper and lower portions and normally aligned therewith and being composed of a series of superposed annular members, said lower, middle and upper portions normally forming an elongated rod-like structure presenting a substantially continuous external surface, restoring means operable to urge said upper portion to return to its normal position in alignment with said lower portion, when the upper portion has been pivoted from said normal position, said restoring means comprising two springs, one of said springs being disposed coaxially with relation to said upper portion and the other spring being disposed coaxially with relation to said lower portion, a third spring disposed within said annular members of said middle portion, thereby providing said radius of flexure, said third spring being coaxial with said first two springs, means interconnecting and engaging said first two springs, said three springs and interconnecting means cooperating to pivot said upper portion about said radius of flexure upon impact from a skier and then to return said pole to an upright position.

2. A pole as claimed in claim 1 wherein each portion is at least partially hollow, and each spring is disposed inside said upper, lower, and middle portions, respectively.

3. A pole as claimed in claim 1 wherein said interconnecting and engaging means comprises platform plates, one of which is located in said upper portion and the other of which is located in said lower portion, each plate engaging one end of a spring, and each plate having an aperture, and a cable extending through said apertures of said plates and a nut secured to each cable end and pressing against said platform plate, thereby pretensioning said cable.

4. A pole as claimed in claim 1 wherein said series of superposed annular members include collars and said third spring cooperates with said collars to provide said radius of flexure.

5. A pole as claimed in claim 1 further comprising means adapted to be engaged by a wrench to facilitate the twisting of the pole about its longitudinal axis to thread said pole into the ground.

6. A pole as claimed in claim 1 wherein said first two springs are compression springs and said third spring is a tension spring.

7. A pole as claimed in claim 1 wherein said threading means are detachably mounted to said pole.

* * * * *